US005671498A

United States Patent [19]

Martin et al.

[11] Patent Number: 5,671,498

[45] Date of Patent: Sep. 30, 1997

[54] SCRUBBING DEVICE

[76] Inventors: Timothy J. Martin; Metta J. Martin, both of 1888 S. Arbutus, Lakewood, Colo. 80228

[21] Appl. No.: 416,176

[22] Filed: Apr. 4, 1995

[51] Int. Cl.[6] ..... A47K 7/03; A47L 13/17

[52] U.S. Cl. ..... 15/244.3; 15/104.93; 15/208; 15/209.1; 15/222; 15/229.11; 15/118

[58] Field of Search ..... 15/104.93, 208, 15/209.1, 229.11, 244.3, 118, 222

[56] References Cited

U.S. PATENT DOCUMENTS

| | | | |
|---|---|---|---|
| 1,820,256 | 8/1931 | Stewart | 15/244.3 |
| 1,961,911 | 6/1934 | Pusch . | |
| 2,230,312 | 2/1941 | Sieb et al. | 15/105 |
| 2,682,678 | 7/1954 | Kingman | 15/118 |
| 2,778,044 | 1/1957 | Mikulski | 15/118 |
| 2,910,710 | 11/1959 | Corrington et al. | 15/118 |
| 2,958,885 | 11/1960 | Donney | 15/244.3 |
| 3,040,353 | 6/1962 | Gray | 15/244.3 |
| 3,169,264 | 2/1965 | Walker | 15/118 |
| 3,226,751 | 1/1966 | Lemelson | 15/118 |
| 3,514,802 | 6/1970 | Keech | 15/208 |
| 3,629,896 | 12/1971 | Sirnec | 15/244.3 |
| 4,004,376 | 1/1977 | Schepp et al. . | |
| 4,015,306 | 4/1977 | Fenster | 15/244.3 |
| 4,287,633 | 9/1981 | Gropper | 15/244.3 |
| 4,343,061 | 8/1982 | Hanazono | 15/244.3 |
| 4,600,620 | 7/1986 | Lloyd et al. | 15/104.93 |
| 5,126,137 | 6/1992 | Lambert | 15/244.3 |

FOREIGN PATENT DOCUMENTS

| | | | |
|---|---|---|---|
| 149705 | 7/1985 | European Pat. Off. | 15/208 |
| 951582 | 3/1964 | United Kingdom | 15/229.11 |
| 2061709 | 5/1981 | United Kingdom | 15/104.93 |

*Primary Examiner*—Mark Spisich

*Attorney, Agent, or Firm*—Timothy J. Martin; Michael R. Henson

[57] ABSTRACT

A scrubbing device provides a first layer of foam material with a second layer of woven synthetic in contact therewith. Preferably the first layer is formed of a close-cell material that is in the shape of a rectangular pad. The second layer is preferably a polyester filament woven with a non-raveling weave. The pad may be encased by the second layer in a partially compressed state. Alternatively, the foam material and the woven synthetic layer can be adhered to one another.

15 Claims, 5 Drawing Sheets

SCRUBBING DEVICE

FIELD OF THE INVENTION

The present invention generally relates to articles of manufacture in the form of cleaning devices which may be used to clean surfaces. More specifically, however, the present invention is directed to scrubbing devices which are able to remove unwanted scales or debris from such surfaces. Especially, the present invention concerns the exfoliation of dead cells from skin.

BACKGROUND OF THE INVENTION

The general notion of cleanliness has long been recognized as a desirable condition which makes existence more pleasant. This desire for cleanliness extends both for the environment in which we live as well as to cleanliness of the body. Not only is the cleanliness of one's surroundings and body generally more enjoyable but also is more healthy by the elimination of germ growth.

For example, in areas used for food preparation, it is well known that bacteria and other disease causing organisms may readily grow on residual food particles and other organic residue or films so that precautions must be taken to eliminate such residue from counter-tops, sinks, cooking utensils and the like. Accordingly, the need to maintain food preparation surfaces and cooking and eating utensils in a sanitary manner has long been recognized. From early use of cleaning rags and cloths, more advanced scrubbing devices have been developed, especially for kitchen use. Examples of different scrubbing or washing devices may be found in early issued United States Letters Patent. For example, one such device is described in U.S. Pat. No. 1,961,911 issued Jun. 5, 1934 to Pusch. Here, a nitro-cellulose lacquer is coated on the nap size of a terry cloth panel. This lacquer is then broken up so that the individual loops have hardened masses of the lacquer thereon thus providing an abrasive, scrubbing surface.

U.S. Pat. No. 2,778,044 discloses a wash pad constructed with a pocket adapted to contain soap powder and which has a flap which may close the pocket for use. A portion of the wash pad is coated with an abrasive or scouring material which may be selectively concealed or exposed by the folding arrangement with the pocket. The scouring portion is composed of a cloth or fabric backing which is coated with a suitable abrasive or other hard scouring material for example, steel wool.

U.S. Pat. No. 2,910,710 issued Nov. 3, 1959 to Corrington et al teaches the use of a water absorbent dish cloth having a localized area in the form of a plastic material pad for scouring. Here, a section of plastic material is woven so as to have alternating ridges and valleys. The section is then folded over a corner of a water absorbent cotton dish cloth and secured thereto by stitching. The cloth is then used to clean utensils and food preparations surfaces while the plastic section may be used for scrubbing unwanted food scales from the surfaces.

U.S. Pat. No. 3,169,264 issued Feb. 16, 1965 to Walker provides a cleaning cloth that may be used for household and personal cleaning. The wash cloth disclosed in this patent comprises two separate layers of different material secured together only at the outside border of the composite cloth. One of the layers is disclosed to be a soft, porous cloth, such as cotton. The other layer is a mesh formed, for example, of nylon, with the mesh sides having openings larger than mosquito netting, preferably approximately ⅛" square. The nylon layer thus provides a mildly abrasive surface while the backing layer may hold water and other cleansing liquids.

U.S. Pat. No. 3,226,751 issued Jan. 4, 1966 to Lemelson discloses a sponge upon which a mesh of wire or plastic filaments are adhered to provide an abrasive surface on at least one side of the sponge. The attachment of the abrasive filaments is accomplished by embedding ends of the filaments into the sponge body during formation.

U.S. Pat. No. 3,514,802 issued Jun. 2, 1970 to Keech discloses a wash cloth somewhat similar to that described in the '264 Patent to Walker as discussed above. The '802 Patent, however, a braided nylon mesh having hexagonal openings is secured to a wash cloth by means of stitching around the border and by parallel stitching lines across the main body thereof. The hexagons have a width of approximately ¼" (0.65 centimeter).

Other products on the market utilize sponges to which a layer of abrasive material is either adhered or supported. For example, a cookware sponge produced by Reckitt & Colman, Inc. of Wayne, N.J. employs a sponge base to which a fibrous mass of mildly abrasive material is bonded. A cleaning pad sold under the trademark Dobie® distributed by The Dial Corporation of Phoenix, Ariz. employs a sponge body that is received in a large mesh woven plastic envelope.

While the above described articles all have their advantages in providing an abrasive surface, none are believed to have received wide acceptance for personal hygiene in scrubbing the human skin. A probable reason for this is that these devices typically are designed for use in the kitchen, especially for scrubbing pots and pans so that the abrasive surface is typically too harsh for the human skin. Therefore, although it is known that skin tone may be improved by scrubbing a skin surface to exfoliate dead cells therefrom, very few products are on the market for this purpose.

A predominate product marketed for the exfoliation of cells from the human skin is known as the loofah. The loofah is a natural gourd type vegetable which has a fibrous structure which, when dried and processed, provides an abrasive surface for skin treatment. Loofah products are in the form of pads or sponge-like masses which may be manipulated against the skin, especially the elbows, knees, feet and other calloused regions, to soften the skin and remove dead skin cells.

Loofah products, however, are not without their drawbacks. Even though a natural fiber, the loofah is still quite abrasive and is not gentle on the skin. Thus, it is typically not suitable for use with infants or those with sensitive skin. Moreover, the interfiber openings tend to collect soap, dirt, dead skin cells and the like which soon results in an unsanitary situation.

Accordingly, despite the advancements in cleaning articles described above, there remains a need for improved structures that provide scrubbing articles that may be used to clean surfaces in order to provide a more sanitary environment. Moreover, there is a need for an improved scrubbing device that may be used on the human body where a milder abrasive action is desirable. There is a further need for a scrubbing device which itself may be readily cleaned for reuse over an extended lifetime.

SUMMARY OF THE INVENTION

It is an object of the present invention to provide a new and useful scrubbing device which may be used to remove unwanted scales from a surface.

A further object of the present invention is to provide a new and useful exfoliation device for removing dead cells from human or animal skin.

A further object of the present invention is to provide a scrubbing device having a mildly abrasive scrubbing surface which may be used for cleaning surface, utensils and the like.

Yet another object of the present invention is to provide a durable scrubbing device having an abrasive fabric supported by a sponge, either open celled or closed celled, which, depending upon construction, may be used in a variety of different applications.

Yet a further object of the present invention is to provide a disposable scrubbing device that is preimpregnated with an antibacterial detergent and which is inexpensive to produce so as to be disposable.

Still another object of the present invention is to provide a scrubbing device that remains sanitary during use and which itself may be cleaned for reuse many times over its lifetime.

According to the present invention, then, a scrubbing device is provided that is particularly useful in manually dislodging unwanted scales from a target surface. Broadly, the scrubbing device has a first layer of a first material which is operative to form a base panel that may be gripped for manipulation by the hand of a human user. A second layer of a second material is disposed in contact with and is mechanically retained and supported by a first layer. This second layer is formed as a flexible sheet of woven strands of synthetic material which defines a smooth yet open mesh having mesh openings less than approximately 1/16" (1.6 millimeter) thereby providing a mildly abrasive working surface. The user may grip the base panel and manipulate the second layer so that movement of the working surface against the target surface abrades scales therefrom.

The first material is a resilient foam or sponge which may be either of closed celled or open celled construction. Alternatively, the first material may be a fabric. The first and second layers may be mechanically adhered to one another, by adhesive or, where the first material is a fabric, it may be adhered by stitching. Here also, it is desired that the first and second layers have common geometric shapes so that the stitching may be located along the common upper peripheral margins of the two layers. Stitching may also be provided along mid-portions within the peripheral margins.

Where the first layer of material is formed as a foam pad, the second layer may be formed as a sleeve operative to receive the foam pad therein, and, if desired, the opposite ends of the sleeve may be fastened together. Preferably, the foam pad partially yet not fully compressed when received in the sleeve. Moreover, it is preferred that the foam pad be rectangular in shape such that the sleeve is also rectangular; alternatively, the foam pad may be cylindrical in shape and the sleeve may also be cylindrical. In one embodiment of the invention, the first and second layers are similarly sized rectangular pieces joined together as a rectangular body. Here, a restraining strap is disposed along one edge of the rectangular body and supports cooperative fasteners so that the rectangular body may be rolled and secured into the rolled condition by means of the restraining strap.

In another form of the invention, straps are secured to opposite sealed ends of the combined first and second layers so that the straps extends oppositely one another to terminate in free strap ends. These first and second straps should have a sufficient length so that the free ends can be grasped by a human user while the sleeve is positioned in contact with the user's back. In this configuration, the straps may be formed of a terry cloth material. Alternatively, a single elongated terry cloth strap may be provided with a resilient foam pad covered by the second layer to secure the foam pad to the terry cloth strap at a mid-portion thereof.

In any event, it is preferred that the second layer be formed by a polyester netting which is woven with the non-ravelling weaver out of a thread size of approximately **20*d*** monofilament. This material should be woven at approximately 4,000 meshes per square inch. Alternatively, a nylon or other similar material may be used.

It is also within the scope of this invention to impregnate the first layer of material with an antibacterial detergent substance. Here, it is also desirable that the scrubbing device be contained in a hermetically sealed yet partible packet.

These and other objects of the present invention will become more readily appreciated and understood from a consideration of the following detailed description of the exemplary embodiments when taken together with the accompanying drawings, in which:

DETAILED DESCRIPTION OF THE EXEMPLARY EMBODIMENTS

According to the present invention, a new and useful scrubbing device has been developed for use in manually dislodging unwanted scales from a target surface. Of particular interest to the present invention is the exfoliation of dead skin cells from the epidermis or surface skin of a human body, although this invention could equally well be used on the skin of an animal, where desired. Moreover, the present invention has usefulness in providing a device for scrubbing other surfaces, such as countertops, appliance surfaces and the like, for sanitary reasons, and is quite useful for scrubbing cooking and eating utensils, as well.

In its broadest form, the present invention contemplates the formation of a base panel out of a first layer of material that may be gripped for manipulation by the hand of a human user and the disposition of a second layer of material in contact with this first layer in such a manner that the second layer is mechanically retained against the second layer. This second layer is formed as a flexible sheet of woven strands of a synthetic material defined by open mesh of small mesh size that provides a mildly abrasive working surface.

Preferably, the second or abrasive layer is formed by a polyester netting of 20*d* monofilament stitched with a non-ravelling weave known as the "leno effect" having a mesh count of approximately 4,000 meshes per square inch. This material is selected because it forms a very mildly abrasive surface that is relatively smooth on, for example, the human skin. Moreover, because it is hydrophobic, the polyester mesh does not, itself, absorb moisture although the mesh size allows for the passage (although somewhat restricted) of water therethrough. However, abraded scales, such as skin cells and food particles, for example, do not readily pass through the mesh layer to the underlying or "support layer". It should be understood, however, that other materials may be used which exhibit similar properties, but it is desirable that the mesh openings have less than a size of 1/16 inch (1.6 millimeter), in any event.

Figure 1:
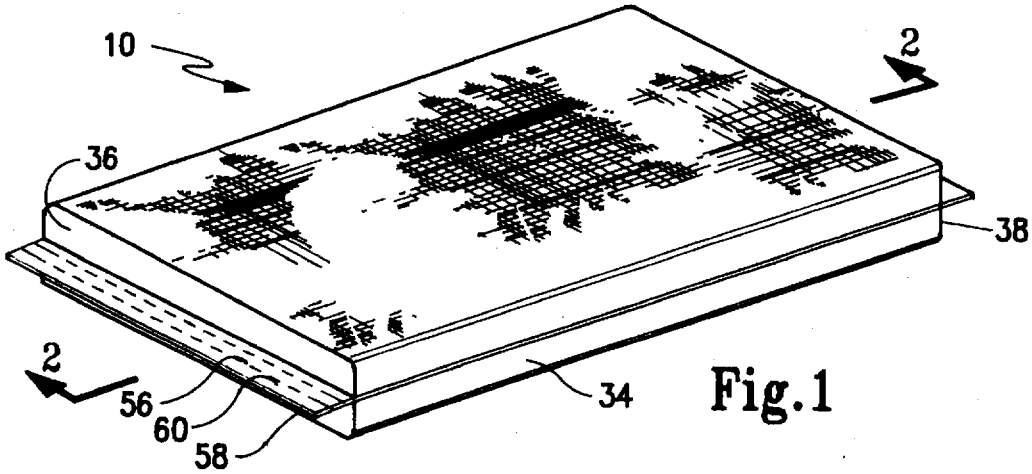
FIG. 1 is a perspective view of a first exemplary embodiment of a scrubbing device according to the present invention.
Figure 2:
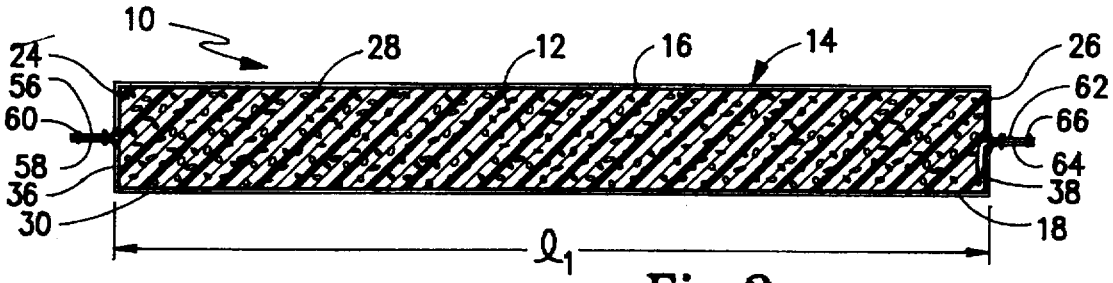
FIG. 2 is a cross-sectional view taken about lines 2—2 of FIG. 1.
Figure 3A:
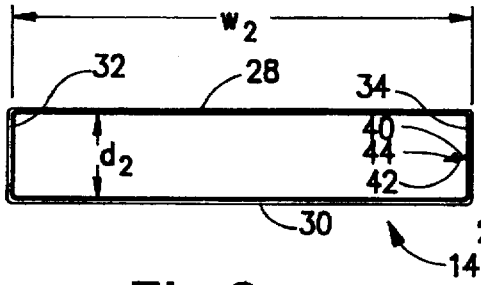
FIG. 3(*a*) is a side view in cross-section of a foam pad used with the embodiment of the invention shown in FIGS. 1 and 2 while FIG. 3(*b*) is a side view in cross-section showing the surrounding sleeve used with the embodiment of the invention shown in FIGS. 1 and 2.
Figure 3B:
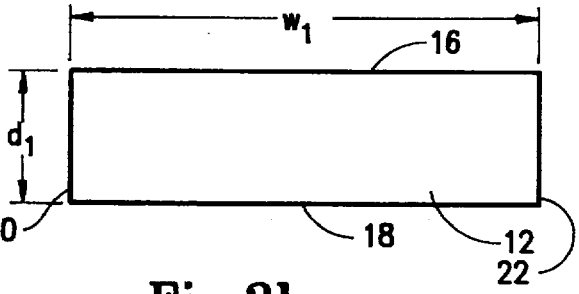

A first exemplary embodiment of the present invention, then, is shown in FIGS. 1–3. In FIG. 1, it may be seen that scrubbing device 10 has a first layer 12 formed of a sponge-like material that is either an open or a closed celled foam. Accordingly, as used herein, the word "foam" is intended to incorporate any sponge-type material. It should be understood, however, that other suitable materials might also be employed for first layer 12. In any event, first layer 12 is encased entirely within a sleeve 14 of second material which is the mildly abrasive material described above. In FIGS. 1–3, first layer 12 is in the form of a rectangular foam block having an upper surface 16 and a lower surface 18 separated by a first thickness "$d_1$" therebetween when in a relaxed or non-compressed state. Further, foam body 12 has a width "$w_1$" between opposite side surfaces 20 and 22, and a first length "$1_1$" between opposite end surfaces 24 and 26.

The second layer in the form of sleeve 14 is thus configured as a rectangular sleeve having a top panel 28 and an opposed bottom panel 30 separated by a distance "$d_2$". Moreover, sleeve 14 has opposed side panels 32 and 34 separated by a width "$w_2$", and end panels 36 and 38 which are separated by a distance equal to "$1_1$". As is shown in FIGS. 3(*a*) and 3(*b*), it is preferred that the distance "$d_2$" of separation between top panel 28 and bottom panel 30 is smaller than the thickness or distance of separation "$d_1$" between upper surface 16 and lower surface 18 of foam body 12, in any event, the distance "$d_2$" should be no larger than the first width as measured by distance "$d_1$". However, it is preferred that width "$w_2$" be equal to width "$w_1$", with the length of the foam body 12 being the same as the distance or length between end panels 36 and 38, as noted above.

With this construction, when foam body 12 is enclosed or encased within sleeve 14, it is in a partially, though not fully, compressed state, as is shown in FIG. 2. In this manner, panels 28 and 30 of sleeve 14 are mechanically retained against surfaces 16 and 18 of foam body 12 by the expansive force of the foam material.

As is shown in FIGS. 1, 2 and 3(*b*), sleeve 14 is formed by a single sheet of flexible woven polyester strands, of the type described above, which has opposite end margins 40 and 42 sewn together such as by stitching 44. This forms a tube-shaped construction into which foam body 12 may be inserted. End margins 56 and 58 may then be secured by stitching 60 and, similarly, end margins 62 and 64 may be secured by stitching 66. Naturally, other means of sealing these margins together may be employed, as desired.

Depending upon the desired application for scrubbing device 10, different compositions of the first layer or foam body 12 may be selected. For example, where a relatively soft, mild abrasive scrubbing device is desired, foam body 12 is selected to have a small spring constant so that it is easily compressed and thus exerts a gentle expansive force against panels 28 and 30 of sleeve 14. This may be desirable for an exfoliation device used on the skin of a baby or other small child, and even an adult, where a very gentle exfoliation device is desired. On the other hand, where the ability for more forceful scrubbing is desired, foam body 12 should be selected to have a higher spring constant so that more tension is placed on top and bottom panels 28 and 30. Furthermore, where it is desired that the scrubbing device 10 also be used for retaining water, detergent or the like, foam body 12 should be made of an open celled construction. Such open celled construction, however, has the disadvantage of entrapping any food particles, skin cells or the like which penetrate through the second, outer layer. Thus, where a more sterile environment is desired, foam body 12 may be a closed-celled construction which reduces the possibility of entrapping unwanted materials within the foam body 12.

Figure 4:
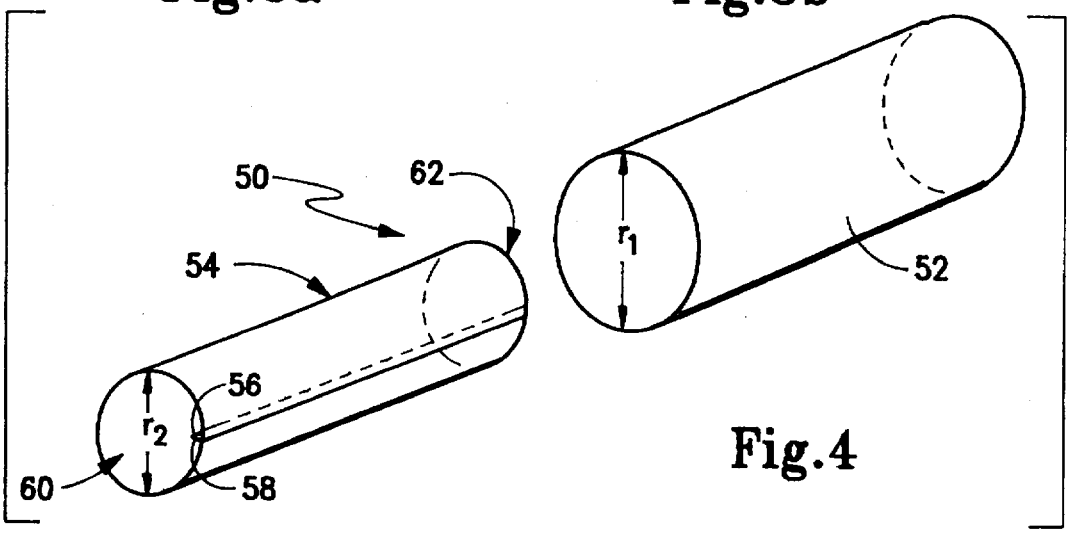
FIG. 4 is an exploded perspective view of a second exemplary embodiment of the present invention in an unassembled state.
Figure 5:
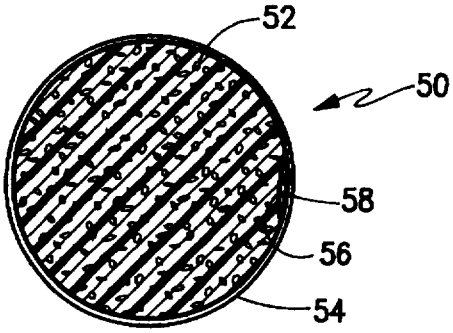
FIG. 5 is a cross-sectional view of the invention shown in FIG. 4 in an assembled state.

A second embodiment of the present invention is shown in FIGS. 4 and 5. This embodiment is similar to that described in FIGS. 1–3, but the resulting scrubbing device 50 is cylindrical in configuration. As is shown in FIG. 4, a first layer of foam material defining foam body 52 is formed as a cylinder having a relaxed radius "$r_1$". This cylindrical foam body 52 is then inserted into a cylindrical sleeve 54 that provides a second, outer layer formed by a flexible sheet of the mildly abrasive, woven synthetic material described above that has edge margins 56 and 58 sewn together. Sleeve 54 thus has a radius "$r_2$" that is smaller than radius "$r_1$". Foam body 52 is inserted through one of open ends 60, 62 of sleeve 54 so that it is encased completely around its circumference by means of sheet 54 which thus forms a second, outer layer for scrubbing device 50 that may be used to abrade unwanted scales from a target surface. Again, the selection of the flexible synthetic sheet forming sleeve 54 and the composition of foam body 52 may be selected depending upon the desired application of scrubbing device 50.

Figure 6:
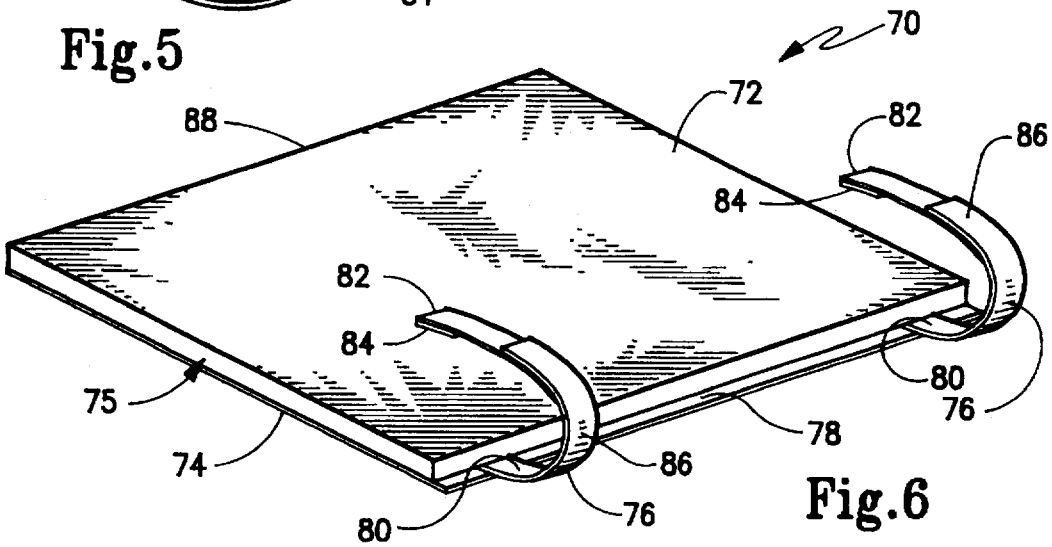
FIG. 6 is a perspective view of a third embodiment of the present invention in an unrolled state.
Figure 8:
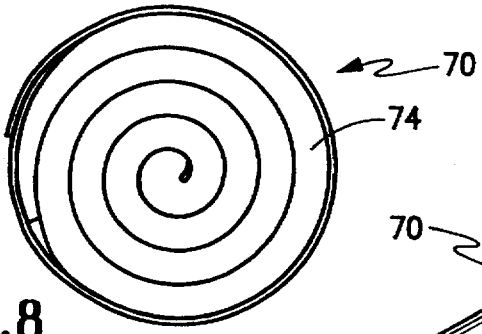
FIG. 8 is an end view in elevation of the embodiment of the present invention shown in FIG. 7.
Figure 7:
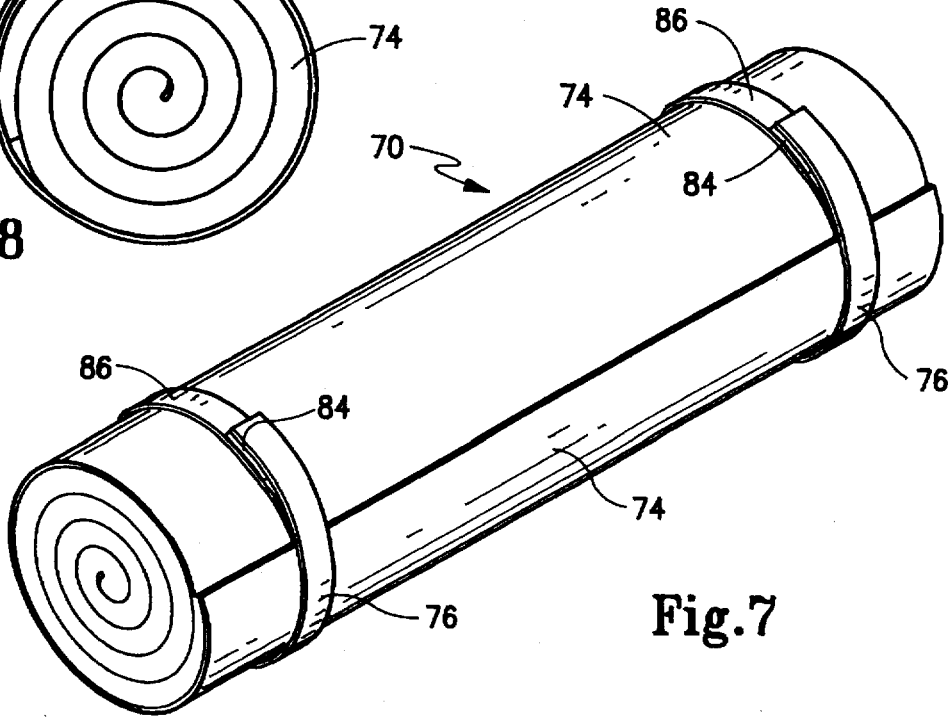
FIG. 7 is a perspective view of the embodiment of the present invention shown in FIG. 6 in a rolled and secured state.

A third exemplary embodiment of the present invention is shown in FIGS. 6–8. Here, scrubbing device 70 is formed by a rectangular foam body 72 which is mechanically adhered to a sheet 74 to form body 72. Sheet 74 is formed of the second material that is a flexible sheet of the mildly abrasive synthetic material, again as described above. Foam body 72 and sheet 74 may be mechanically affixed to one another in any convenient manner known in the art, such as by stitching, an adhesive or, where possible, by the direct molding of foam body 72 onto sheet 74. In any event, foam body 72 and sheet 74 are similarly sized rectangular pieces that define a rectangular body, and a pair of restraining straps 76 are provided along one common edge 78 of foam body 72 and sheet 74. Restraining straps 76 have proximal ends 80 which are joined to the rectangular body defined by foam body 72 and sheet 74 and terminate in free distal ends 82. Cooperative fasteners are provided on each restraining strap 76, preferably in the form of hook and loop fasteners formed by filiform elements 84 located proximately to each distal end 82 on one side of restraining strap 76, and loop elements 86 located on a mid-portion of each restraining strap 76 on a side thereof opposite filiform elements 84.

Accordingly, as is shown in FIGS. 7 and 8, rectangular body 75 may be rolled from an edge 88 opposite edge 78 in a manner such that a portion of sheet 74 is completely exposed around the circumference of the resulting cylindrical body. Restraining straps 76 may then be secured to hold this cylindrical, spiral-wrapped configuration. In use, scrubbing device 70 may be unwrapped to the configuration shown in FIG. 6 and used more like a washing/scrubbing cloth or other cleaning device which has a mildly abrasive surface 74. For tougher scrubbing applications, such as may be necessary to address callouses on the body or more tougher scales on a countertop or other surface to the cleaned, the scrubbing device 70 may be wrapped into the configuration shown in FIGS. 7 and 8 so that more mechanical advantage can be applied by a human user.

Figure 9:
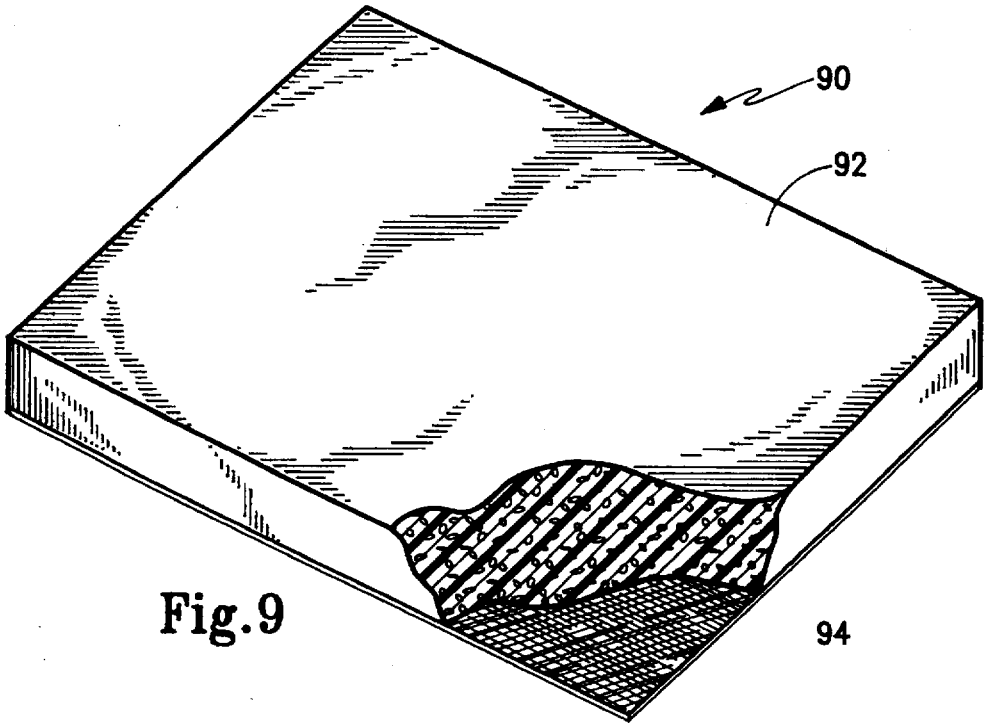
FIG. 9 is a perspective view, partially cut-away, showing a fourth exemplary embodiment of the present invention.

A fourth exemplary embodiment of the present invention is shown in FIG. 9. Here, scrubbing device 90 is an abrasive pad formed simply by a body of foam material such as rectangular foam body 92 that defines a first layer of material affixed to a second layer of material in the form of sheet 94 of the woven synthetic material that provides the mildly abrasive surface. Thus, scrubbing device 90 is similar to scrubbing device 70. However, in the embodiment shown in FIG. 9, it is desired that the thickness of the foam body 92 be greater than the thickness of foam body 72 since the scrubbing device 90 of FIG. 9 is not intended to be wrapped into a cylindrical configuration. Thus, foam body 92 should be suitably thick so as to facilitate gripping by the human hand so that sheet 94 may be worked against a target surface to dislodge unwanted scales therefrom. Foam body 92 and sheet 94 may be molded together during fabrication so that sheet 94 is mechanically secured to foam body 92 and retained thereagainst, or, alternatively, sheet 94 may be joined to foam body 92 by any suitable adhesive or other method of mechanical affixation.

Figure 10:
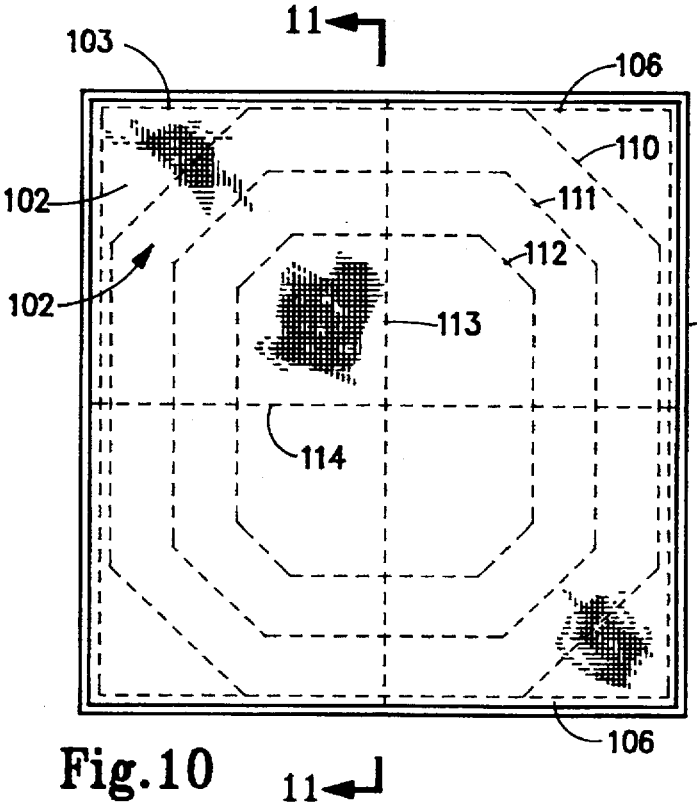
FIG. 10 is a top plan view of fifth exemplary embodiment of the present invention.
Figure 11:
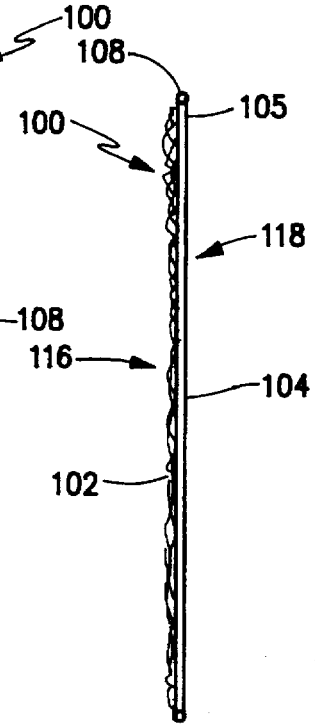
FIG. 11 is a cross-sectional view taken about lines 11—11 of FIG. 10.

A fifth alternate embodiment of the present invention is shown in FIGS. 10 and 11. Here, scrubbing device 100 is formed by a first layer defined by a fabric sheet 102 to which a second sheet 104 of the woven synthetic, abrasive material is affixed. As is shown in FIGS. 10 and 11, each of fabric sheet 102 and abrasive sheet 104 have congruent geometrical shapes so that when superimposed over one another, they have a common outer peripheral margins that may be adhered to one another by stitching. Thus, for example, each of sheets 102, 104 are generally rectangular, and specifically square, in shape. Fabric sheet 102 thus has a surrounding outer peripheral margin 103 which is joined to outer peripheral margin 105 of sheet 104 by means of stitching 106, and a finished hem 108 may be provided, if desired. Also, if desired, inner stitching, such as octagonal stitching lines 110–112 may be provided along with longitudinal and transverse stitching lines 113 and 114 to join respective mid-portions of sheets 102 and 104. The resulting scrubbing device 100, is therefor like a wash cloth or "dish rag". Fabric sheet 102 may be any suitable absorbing material, such as a soft cotton cloth, and, may conveniently be a terry cloth material or the like. Here again, scrubbing device 100 may be used as a bath article for scrubbing the skin of a person. Here, surface 116 formed by the fabric sheet 102 may be used as a typical wash cloth, while surface 118 formed by sheet 104 may be used for exfoliating the skin. Likewise, in kitchen use, surface 118 may be used as an abrasive to remove scales from a countertop, cooking utensil, etc., which surface 116 may be used to wipe or dry the surface. It should be understood, with the above described construction, that scrubbing device 100 presents one surface, that is surface 118, that is hydrophobic while providing a second surface layer, that is, surface 116, that is hydrophilic.

Figure 12:
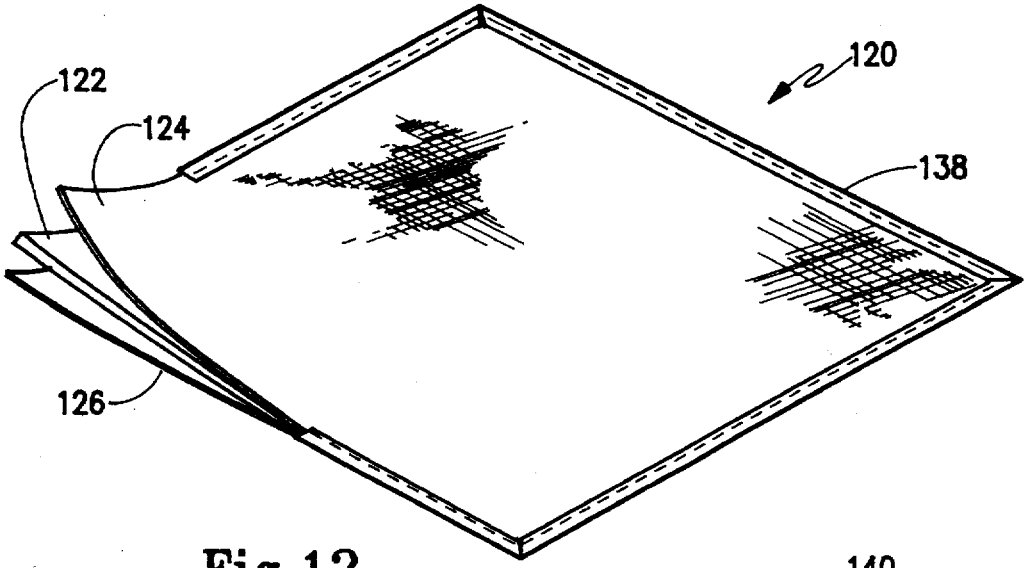
FIG. 12 is a perspective view, partially cut-away and exploded, showing a sixth exemplary embodiment of the present invention.
Figure 13:
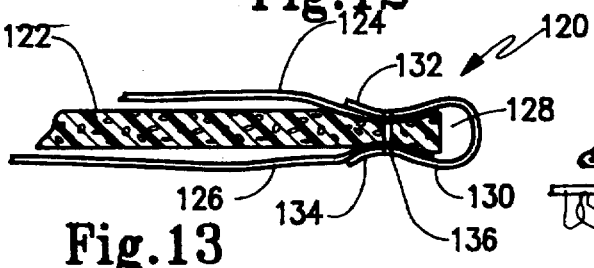
FIG. 13 is a cross-sectional view of an edge portion of the embodiment of the present invention shown in FIG. 12.

A sixth exemplary embodiment of the present invention is shown in FIGS. 12 and 13. Here, scrubbing device 120 is formed by three layers of material. An innermost layer 122 is formed by a relatively thin sheet of foam material that is interleaved between outer sheets 124 and 126. Layer 124 is in the form of a sheet of mildly abrasive and hydrophobic material described above, while it is preferred that layer or sheet 126 be an absorbent, cotton layer that is hydrophilic. Layers 122, 124 and 126 have common peripheral edge 128 which is joined by binding 130 that encircles edge 128 with opposite walls 132 and 134 of binding 130 being joined by stitching 136 to create a finished edge extending completely around the periphery 138 of scrubbing device 120.

Figure 14:
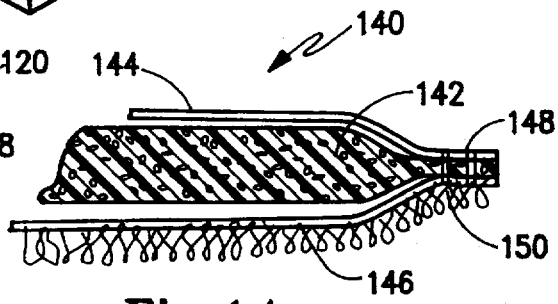
FIG. 14 is a cross-sectional view of an edge portion of the invention shown in FIG. 12 showing an alternative construction therefor.

A slight modification to the scrubbing device shown in FIGS. 12 and 13 is depicted in FIG. 14 wherein a seventh alternative embodiment of the present invention in the form of scrubbing device 140 is shown. Here, an inner foam layer 142 is interleaved between an outer sheet 144 of abrasive material and outer sheet 146 formed of terry cloth. Here, common edges 148 are directly secured together by means of stitching 150.

Figure 15:
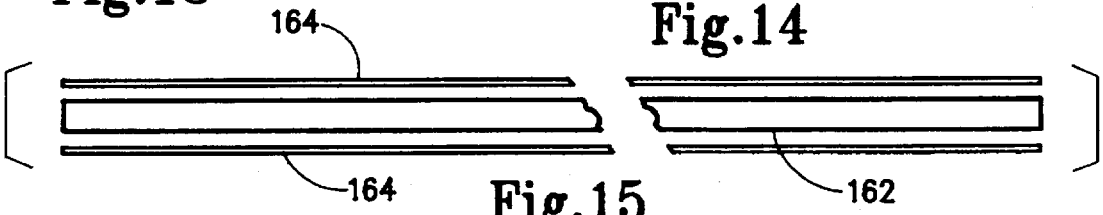
FIG. 15 is a side view in elevation showing forming layers to create another alternative embodiment of the present invention.
Figure 16:
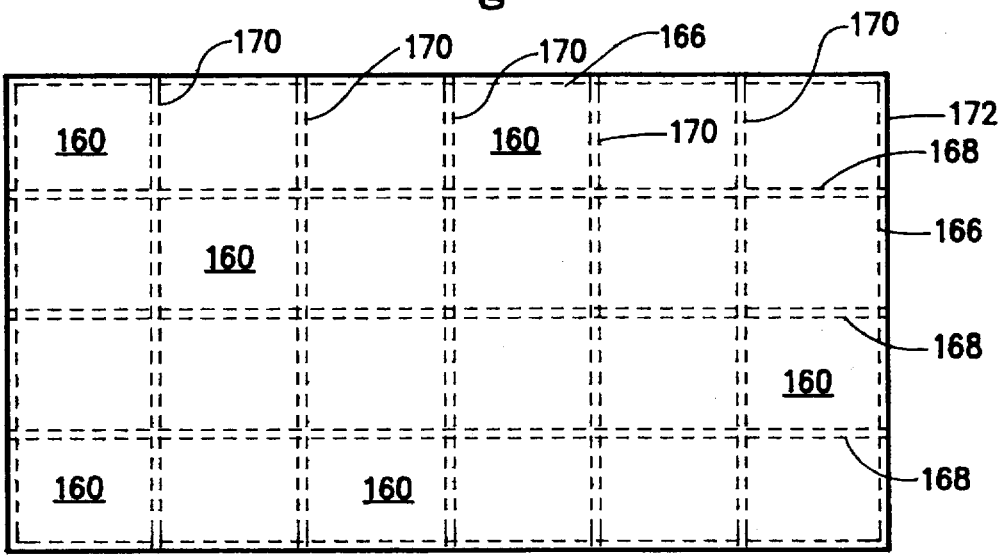
FIG. 16 shows a top plan view of the layers of the invention shown in FIG. 15 used to produce a plurality of scrubbing device according to this embodiment.
Figure 17:
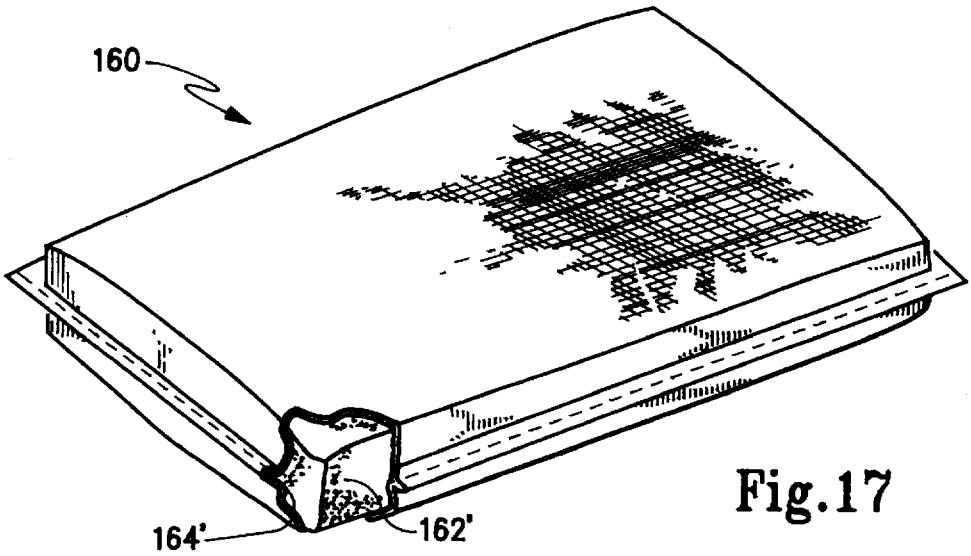
FIG. 17 is a perspective view, partially broken-away, showing a completed scrubbing device of formed by the structures of FIGS. 15 and 16.

An eighth alternative embodiment of the present invention is shown in FIGS. 15–17, and these figures depict an inexpensive method of manufacture of a scrubbing device similar to the scrubbing device shown in FIGS. 1—3. In FIGS. 15 and 16, it may be seen that a foam sheet 162 may be placed between a pair of sheets 164 of the mildly abrasive material, and these sheets may be joined together, as is shown in FIG. 16, by outer peripheral stitching 166 and pairs of longitudinal stitching lines 168 and pairs of transverse stitching lines 170 to form individual scrubbing devices 160. In creating these stitching lines, foam pad 162 is slightly pre-compressed by the mechanical stitching so as to exert an expansive force against sheets 164 thereby holding them each in a taut condition. After the formation of a plurality of joined scrubbing devices 160, the enlarged panel 172 may be cut between each pair of longitudinal stitching 168 and between each pair of transverse stitching 170 to sever the individual scrubbing devices 160 from one anther. The result, as is shown in FIG. 17, is a scrubbing device 160 in which foam body 162' is completely encased within an abrasive sheet 164' formed of the mildly abrasive, hydrophobic mesh material. Here again, the selection of the foam for foam layer 162 may be as desired depending upon the target application of scrubbing device 160.

Figure 18:
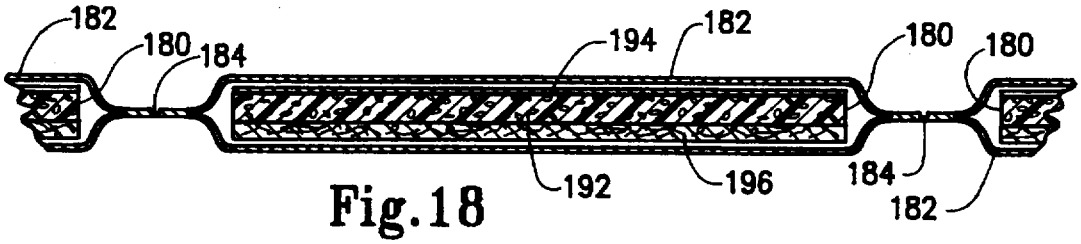
FIG. 18 is another embodiment of the present invention showing the scrubbing device in disposable form.

A ninth embodiment of the present invention is shown in FIG. 18, and this figure depicts a disposable form of a scrubbing device 180 that is packaged as a plurality of units in packet form. Thus, as is shown in this figure, each scrubbing device 180 is received and hermetically sealed in a partible packet 182 formed of plastic, foil or other known material and, if desired, a plurality of packets 182 may be interconnected to one another yet are severable along score lines 184. While the form of this scrubbing device received within each packet 182 may be any variation of the scrubbing device as described above, it is preferred that scrubbing device 180 be formed by an inner layer 192 of inexpensive, open celled foam that has a first outer layer 194 mechanically adhered thereto with outer layer 194 being a sheet of the mildly abrasive synthetic material described above. A second outer layer 196 is opposite layer 194 and is preferably an absorbent cotton or cellulose-based, relatively soft material. Thus, layer 196 provides a gentle wiping surface while layer 194 provides a mildly abrasive surface. Scrubbing device 180, in packet form 182 is contemplated for hospital or other medical applications, and it is intended that each scrubbing device 180 be disposable after one use. Moreover, it is desired that each scrubbing device 180 be impregnated with an anti-bacterial detergent substance and then packed for use.

In use, then, a nurse or other care provider selects a packet 182 containing a scrubbing device 180 and opens the packet to withdraw scrubbing device 180. Scrubbing device 180 may be directly used since it is contemplated that the anti-bacterial detergent will be in water solution, but, alternatively, the care provider may wet scrubbing device 180 if desired. Where the skin of a patient is to be exfoliated, the care provider may use the surface provided by outer layer 194, after which the exfoliated region may be wiped by outer surface 196. Thus, scrubbing device 180 may be used to care for various skin conditions on patients. Moreover, it is contemplated that scrubbing device 180 may be used to cleanse an area prior to the insertion of an interveneous device or for the attachment of monitoring electrodes or other monitoring apparatus.

Figure 19:
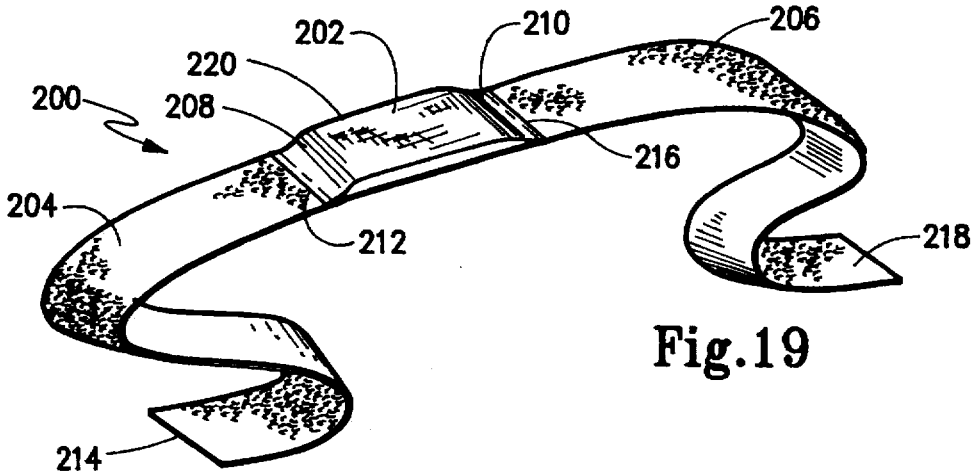
FIG. 19 is a perspective view of another alternative embodiment of the present invention.

Finally, with reference to FIG. 19, it may be seen that a bath article 200 may be created to incorporate a scrubbing device 202 according to the present invention. Here, scrubbing device 202 is similar to scrubbing device 10 and scrubbing device 160, although any scrubbing device constructed according to the concepts described above would be acceptable. However, in the article shown in FIG. 20, first and second elongated straps 204 and 206 extend oppositely from sealed ends 208 and 210 of scrubbing device 202. Thus, strap 204 has a first end 212 which is secured to sealed end 208 of scrubbing device 202, and terminates in a free end 214. Likewise, strap 206 has a first strap end 216 that may be secured to scrubbing pad 202, with strap 206 terminating in free end 218. Each of straps 204 and 206 may be constructed of terry cloth material, with scrubbing pad 202 formed by an arc-shaped sheet 220 of the mildly abrasive material described above which receives an inner foam pad (not shown). In any event, straps 204 and 206 are sized so that a human user while scrubbing device 202 is located in contact with the user's back.

Figure 20:
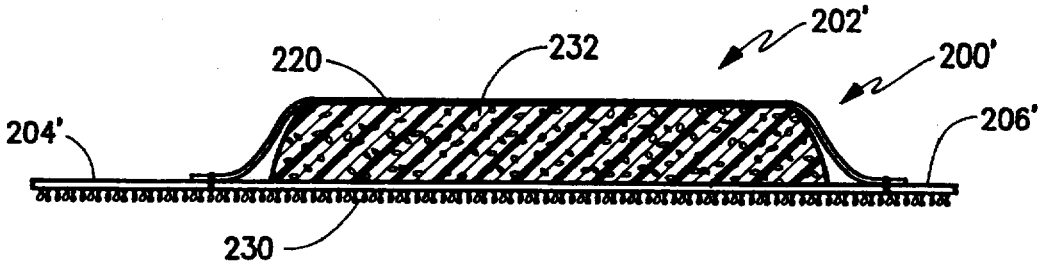
FIG. 20 is a side view in cross-section of a mid-portion of the scrubbing device shown in FIG. 19.

Alternatively, as is shown in FIG. 20, the scrubbing device 200' is similar to that shown in FIG. 19. However, scrubbing device 200' may be formed by an integral band 230 of terry cloth material that defines strap portions 204' and 206' with scrubbing pad 202' being formed by the panel 220 of the mildly abrasive material enclosing a foam pad 232 in a partially compressed state. Scrubbing device 200, shown in FIG. 19, where scrubbing device 200', shown in FIG. 20, is very useful by an individual for scrubbing his/her back since strap ends 214 and 218 may be readily grasped and manipulated so that scrub pad 202 may be manipulated against the back.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

We claim:

1. A scrubbing device adapted for use in manually dislodging unwanted scales from a target surface, comprising:

(a) a first layer of closed-cell foam material operative to form a base panel that may be gripped by a hand of a human user; and (b) a second layer disposed in contact with said first layer and mechanically retained thereagainst, said second layer formed as a flexible sheet of woven strands of polyester material defining a smooth yet open mesh having mesh openings less than 1/16th inch (1.6 mm) to provide a mildly abrasive working surface whereby the user may grip said base panel and manipulate said second layer so that movement of the working surface against the target surface abrades said scales therefrom, said second layer woven with a non-raveling weave.

2. A scrubbing device according to claim 1 wherein said second layer is mechanically adhered to said first layer.

3. A scrubbing device according to claim 1 wherein said first layer is defined by a foam pad having a first selected thickness when in a relaxed state yet which is compressible to a reduced thickness.

4. A scrubbing device according to claim 3 wherein said first said first and second layers are similarly sized rectangular pieces with said first and second layers being joined to one another as a rectangular body and including a restraining strap disposed along a first edge of said rectangular body and including cooperative fasteners associated with said restraining strap whereby said rectangular body may be rolled from a second edge opposite the first edge toward the first edge thereby to be placed in a cylindrically shaped rolled condition with said second layer providing an outer roll surface therefor, said restraining strap sized and adapted to circumferentially encircle the outer roll surface so that said fasteners may be secured thereby to maintain said rectangular body as said rolled condition.

5. A scrubbing device according to claim 3 wherein said scrubbing device is contained in a hermetically sealed yet partible packet.

6. A scrubbing device according to claim 3 wherein said first layer is formed as a cylindrical body having a first diameter defining the first thickness and wherein said second layer is configured as a cylindrical sleeve having a second diameter that is no larger than the first diameter, said cylindrical body being disposed in said cylindrical sleeve.

7. A scrubbing device according to claim 3 wherein said first layer is shaped as a rectangular foam block having opposite upper and lower surfaces separated by the first thickness, opposite side surfaces separated by a first width and opposite end surfaces separated by a first length and wherein said second layer is configured as a rectangular sleeve having opposed top and bottom panels separated by a distance defining a second thickness, a pair of opposed side panels separated by a distance defining a second width that is no larger than the first width, said rectangular block of foam material being disposed in said rectangular sleeve.

8. A scrubbing device according to claim 7 wherein the first thickness is greater than the second thickness such that said rectangular block is disposed in said rectangular sleeve in a partially yet not fully compressed state.

9. A scrubbing device according to claim 7 wherein said rectangular sleeve has opposite first and second sealed ends.

10. A scrubbing device according to claim 9 including first and second straps having respective first strap ends secured to respective ones of said sealed ends so that said first and second straps extend oppositely one another to terminate in respective free strap ends, said first and second straps having sufficient length whereby the free ends thereof can be grasped by a human user while said rectangular sleeve is positioned in contact with the user's back.

11. A scrubbing device adapted for use in manually dislodging unwanted scales from a target surface, comprising:

(a) an enclosure having a surrounding sidewall and opposite ends, at least a portion of said surrounding sidewall being formed as a first sheet of flexible woven strands of a synthetic material defining a mesh; and (b) an inner body of resilient close-cell foam material filling said enclosure and dimensioned such that said inner body is partially compressed thereby to bias opposed portions of said surrounding sidewall apart from one another yet not fully compressed so that a user may grip said device and manipulate an outer working surface against the target surface with additional compression of said inner body thereby to abrade said scales from said target surface.

12. A scrubbing device according to claim 11 wherein said synthetic material is a woven polyester mesh constructed of a non-raveling weave.

13. A scrubbing device according to claim 11 wherein said surrounding sidewall is formed by opposed top and bottom panels, one of said top and bottom panels defined by said sheet and another of said top and bottom panels formed by a second sheet of a second material selected from a group consisting of natural fabric, synthetic fabric and said first material.

14. A scrubbing device adapter for use in manually dislodging unwanted scales from a target surface, comprising:

(a) a unitary flat inner pad of resilient close-cell foam material having opposite first and second pad surfaces;

(b) a first sheet of material disposed alongside the first pad surface and constructed as a finely woven mesh of synthetic material that provides a relatively smooth, mildly abrasive texture, said first material having a mesh size no greater than 256 per square inch; and (c) a second sheet of material disposed alongside the second pad surface, said first and second sheet fastened relative to one another with said inner pad secured therebetween.

15. An exfoliation device adapted for use in manually dislodging dead skin cells from a skin surface of a human body comprising:

(a) an enclosure having a surrounding sidewall and opposite ends, a portion of said surrounding sidewall being formed as a flexible sheet of woven strands of a synthetic material defining a mesh; and (b) an inner body of resilient close-cell foam material filling said enclosure and dimensioned such that said inner body is partially compressed thereby to bias opposed portions of said surrounding sidewall apart from one another yet not fully compressed so that a user may grip said device and manipulate an outer working surface against the skin surface with additional compression of said inner body thereby to abrade said dead cells from said skin surface.

* * * * *